United States Patent [19]

Saitoh

[11] 4,331,844

[45] May 25, 1982

[54] ELECTRIC SWITCH DEVICE

[76] Inventor: Shigeru Saitoh, 6-4, 2-chome, Kuramae, Taito-ku, Tokyo, Japan

[21] Appl. No.: 179,279

[22] Filed: Aug. 18, 1980

[30] Foreign Application Priority Data

Feb. 29, 1980 [JP] Japan ..... 55-152433[U]

[51] Int. Cl.[3] ..... H01H 15/00

[52] U.S. Cl. ..... 200/16 R; 200/60; 200/159 R

[58] Field of Search ..... 200/16 R, 16 C, 16 D, 200/17 R, 18, 60, 159 B, 328, 340

[56] References Cited

U.S. PATENT DOCUMENTS

| | | | |
|---|---|---|---|
| 1,592,225 | 7/1926 | Pieper | 200/60 X |
| 2,445,635 | 7/1948 | Poliakoff | 200/60 X |
| 2,477,516 | 7/1949 | Haas | 200/60 |
| 2,676,217 | 4/1954 | Garbs | 200/60 |
| 3,806,685 | 4/1974 | Seeger, Jr. et al. | 200/159 B X |
| 3,886,341 | 5/1975 | Forrest | 200/60 X |
| 3,992,596 | 11/1976 | Miller | 200/60 |

*Primary Examiner*—James R. Scott

*Attorney, Agent, or Firm*—Michael J. Striker

[57] ABSTRACT

An electric switch device, particularly for toys, has contacts for closing and opening an electric circuit, and a switch button element which is movable between a first position in which it does not act on the contacts so that the latter opens the electric circuit, a second position in which a user applies a pressure to the button element and the latter acts on the contact so that the latter closes the electric circuit, but after removal of the user's pressure the button element returns to the first position, and a third position in which the button element acts on the contacts even after removal of the user's pressure so that the contacts keep the electric circuit closed.

15 Claims, 10 Drawing Figures

ELECTRIC SWITCH DEVICE

BACKGROUND OF THE INVENTION

The present invention relates to an electric switch device particularly for toys.

Electric switch devices for toys are known in the art. The known electric switch devices possess some disadvantages in the sense of the simplicity of their construction and switching possibilities of the same. The known electric switch devices are operative for closing an electric circuit when keys of an electric keyed instrument are pushed, and for opening the electric circuit when the keys are released. However, it is advisable to provide for such an operation of the electric switch device that the electric circuit is continuously maintained in closed condition. The known electric switch devices do not provide for this possibility.

SUMMARY OF THE INVENTION

Accordingly, it is an object of the present invention to provide an electric switch device which avoids the disadvantages of the prior art.

It is also an object of the present invention to provide an electric switch device which can be utilized in inexpensive and durable toys.

More particularly, it is an object of the present invention to provide an electric switch device which not only performs the functions of closing and opening of an electric circuit, but also allows maintenance of the electric circuit in closed condition for a desirable time. In keeping with these objects and with others which will become apparent hereinafter, one feature of the present invention resides, briefly stated, in an electric switch device which includes contact means for closing and opening an electric circuit, and actuating means including a switch button element which is movable between a first position in which it does not act on the contact means so that the latter opens the electric circuit, a second position in which a user applies a pressure to the button element and the latter acts on the contact means so that the latter closes the electric circuit, but after removal of the user's pressure the button element returns to the first position, and a third position in which the button element acts on the contact means even after removal of the user's pressure so that the contact means keeps the electric circuit closed.

When the electric switch device is designed in accordance with the present invention, it is operative not only for closing and opening of an electric circuit, but also for maintaining the electric circuit in closed condition for a desired time.

In accordance with another feature of the present invention, the button element includes a supporting portion and a movable portion which moves relative to the supporting portion between the above mentioned positions. The movable portion includes a button section arranged to be acted on by a user, and a leg section arranged to act on the contact means.

Still another feature of the present invention resides in that the electric switch device has supporting means which includes a cover plate provided with an opening, and the movable portion of the button element has an engaging section which does not engage the cover plate in the first and second positions, but in the third position the engaging section is displaced in a radial direction of the opening and engages the cover plate so that the button element is retained in this third position to constantly act on the contact means and to constantly close the electric circuit.

Yet another feature of the present invention is that the supporting portion of the button element is formed as a reversed gutter provided with two slots which form a springy section which is arranged to move the movable portion of the button element to the first position.

The engaging section is connected with the springy section and offset relative to the latter in the axial direction. The engaging section has a front edge which is substantially rectangular and is inclined and axially raises in direction from the springy section toward the button section of the button element.

In accordance with a further advantageous feature of the present invention, the supporting portion and the movable portion including the springy section, the engaging section, the button section, and the leg section, are of one piece with one another and together form an integral element.

Still a further feature of the present invention is that the leg portion is formed as a triangular plate which has a rounded angular corner arranged to act on the contact means. Yet a further feature of the present invention resides in that the supporting means further includes a guiding plate and a base plate downwardly spaced from the cover plate. The supporting portion together with the springy section and engaging section of the movable portion are guided between the cover plate and the guiding plate. As for the base plate, the latter serves for supporting the contact means.

The contact means may include a stationary contact member which is stationarily mounted on the base plate, and a movable contact member which has one end connected with the baseplate and another end movable relative to the stationary contact member so as to contact or not contact with the latter. The movable contact member is formed as a springy plate fixedly connected by its one end with the base plate. The cover plate, guiding plate, and base plate are parallel to each other.

Finally, the movable portion of the button element is provided with a tail section which is located at the radial opposite side of the button section and abuts against the cover plate when the button element is in the first position.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
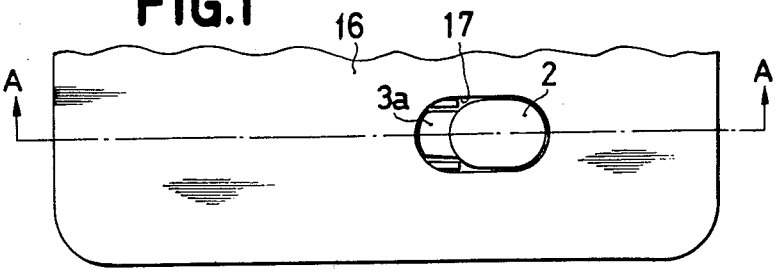
FIG. 1 is a top view of a cover plate with a partially shown switch button element of an electric switch device in accordance with the present invention.
Figure 2:
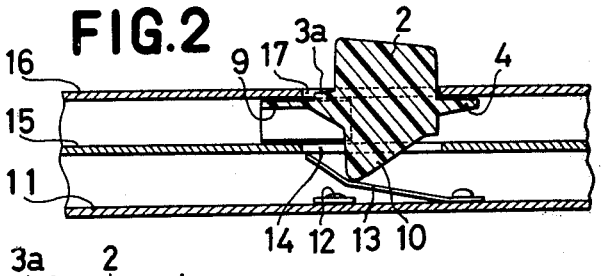
FIGS. 2, 3 and 4 are sections taken along the line A—A in FIG. 1 and showing the switch button element in three different positions.
Figure 3:
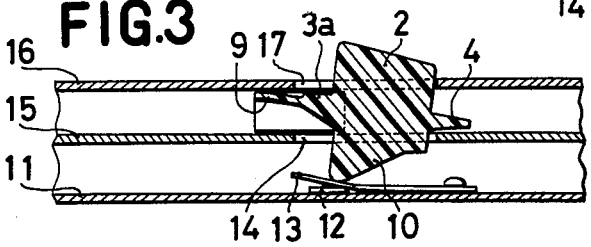
Figure 4:
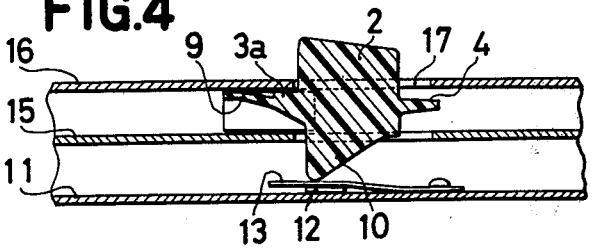
Figure 5:
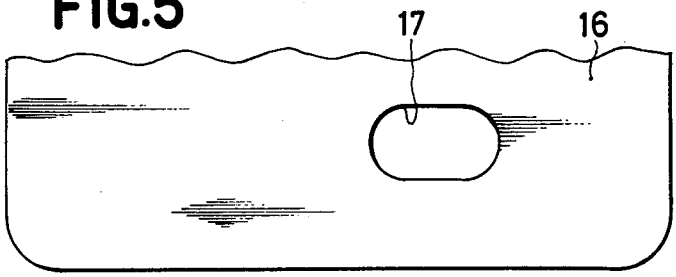
FIG. 5 is a view showing the cover plate of FIG. 1, taken separately.
Figure 6:
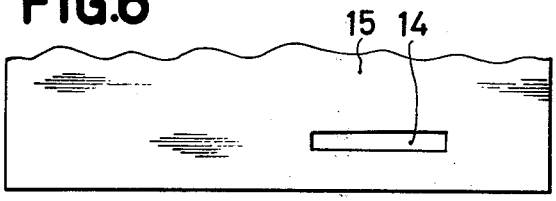
FIG. 6 is a plan view of a guiding plate of the electric switch device in accordance with the present invention.
Figure 8:
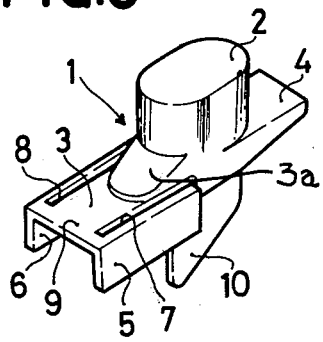
FIG. 8 is a perspective view of the switch button element as seen from above.
Figure 7:
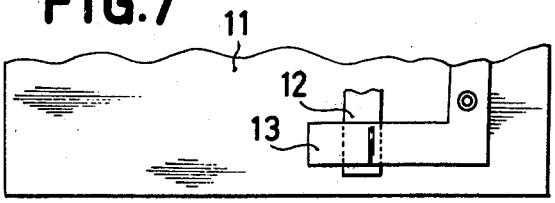
FIG. 7 is a plan view showing a base plate of the electric switch device in accordance with the present invention.
Figure 9:
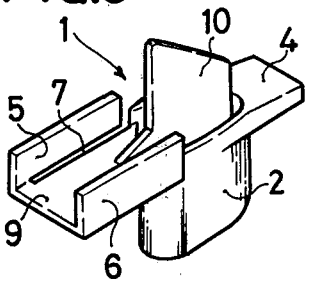
FIG. 9 is also a perspective view of the switch button element as seen from below.

An electric switch device in accordance with the present invention is utilized generally in toys. It has a button-type switch or a switch button element which is identified in toto by reference numeral 1.

The switch button element 1 includes a switch button 2 and a supporting frame 9. The switch button 2 and the supporting frame 9 are of one piece with one another and can be formed as an integral member of plastic material. The supporting frame 9 is shaped like a reversed gutter having two side plates 5 and 6. A pair of slots 7 and 8 are provided in the upper plate of the supporting frame 9 so that a springy plate 3 is formed between the slots.

The springy plate 3 is united with the cylindrical button 2 having an elliptic cross section, by a raised portion 3*a*. The raised portion 3*a* has a substantially rectangular front edge in the region of the springy plate 3, and extends toward the button 2. More particularly, the raised portion 3*a* has an upper surface which is inclined upwardly in direction from the front edge toward the button 2.

The button 2 has a flat tail 4 which is fixed to the rear side of the latter. A leg 10 is provided which is substantially triangular and has a lower corner which is angular and rounded.

The electric switch device is provided with three plates identified by reference numerals 11, 15 and 16. The base plate 11 supports contact means of the device. The contact means includes a stationary contact 12 which is fixedly mounted on the base plate 11, and a springy contact plate 13 which is movable relative to the stationary contact 12. More particularly, the springy contact plate 13 is fixed by its one end to the contact plate 13 and has a free end which extends above the stationary contact 12 and can move relative to the latter. The locations in which the stationary contact 12 and the first end of the contact plate 13 are mounted on the base plate 11, are spaced from one another.

The cover plate 16 is provided with a guide hole 17 which is elongated, and the guide plate 15 has a guide hole 14 which is also elongated in the same direction. The plates 11, 15 and 16 are parallel to one another.

The electric switch device in accordance with the present invention operates in the following manner:

In the first or inoperative position when a pressure is not applied to the button 2, the button 2 extends through the opening 17 upwardly beyond the cover plate 16. The raised portion 3*a* is located substantially in the region of the opening 17. The tail 4 abuts against the cover plate 16 from below. The supporting frame 9 can also abut against the cover plate 16 from below. The leg portion 10 is located so that the contact plate 13 is spaced from the stationary contact 12 and the contact does not close an electric circuit associated therewith. The electric circuit is in its open condition.

When a user wants to close the electric circuit for a short time, it applies pressure to the button 2 in a vertical direction or in direction of an axis of the opening 17. Since the plate 3 is springy, it is bent down and the button 2 with the leg 10 displaces downwardly. The leg 10 pushes down the contact plate 13 and the latter contacts the stationary contact 12, whereby the electric circuit is closed. During this vertical displacement, the raised portion 3*a* remains, nevertheless, within the contour of the opening 17. When the button 2 is released from pushing, it returns to the first or inoperative position under the action of the springy plate 3 and the action of the springy contact plate 13. The contact plate 13 is thereby separated from the stationary contact 12 and the electric circuit opens.

In the case when it is necessary to maintain the electric circuit in closed condition, the button 2 is depressed down and then is slid forward in a radial direction of the opening 17. The raised portion 3*a* is thereby displaced beneath the cover panel 16 and abuts against the latter from below. The leg 10 descends so as to maintain the connection of the contact plate 13 with the stationary contact 12. Even when the button 2 is released from pushing, the raised portion 3*a* is retained beneath the cover panel 16 and the button 2 cannot displace to its first or inoperative position. The contacts 12 and 13 constantly contact with one another and the electric circuit is maintained in its closed condition.

In order to move the switch 1 from the latter described position to its first or inoperative position, the button 2 must be moved rearwardly so that the raised portion 3*a* enters the guide hole 17, the springy plate 3 returns to its original position from the bent position, the button 2 and the leg 10 ascend up so that the springy contact plate 13 is raised and separated from the stationary contact 12. Since the front edge of the raised portion 3*a* is confined by one edge of the guide hole 17 and the rear edge of the button 2 is confined by the other edge of the guide hole 13, the switch button element 1 is stably held in the guide hole 13.

The switch button element 1 can be molded from plastics as a whole by one molding process, and it includes the plastics springy plate as one of its parts. Therefore, it is not necessary to use a steel spring plate. Since the supporting means of the electric switch device in accordance with the present invention includes the cover plate 16, the guide plate 15, and the base plate 11, the cover plate 16 may serve as an upper shell of a toy, whereas the base plate 11 supports the contact 12 and 13. Furthermore, the base plate 11 may be provided with a printed wiring plate and other parts. Therefore, the manufacture of the toy may be facilitated. In the case of providing a plurality of the switch buttons on the cover plate as shown in FIG. 10, the guide holes 17 and 14 of the cover plate 15 and the guide plate 15 may be easily bored in predetermined and suitable positions of the plates to correspond to the position of the contacts 12 and 13 of the base plate 11.

Figure 10:
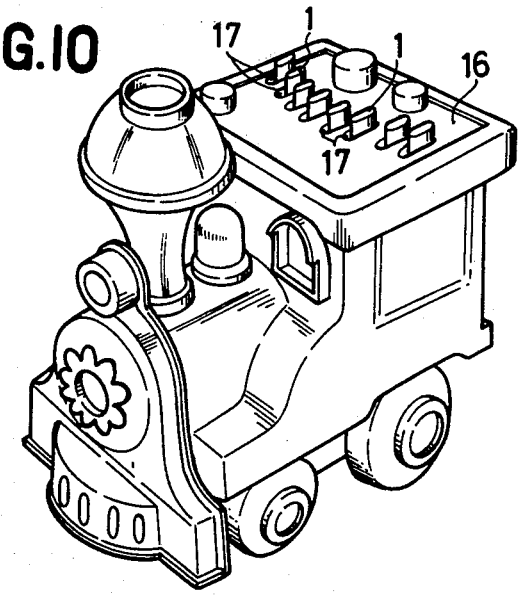
FIG. 10 is a view showing a toy provided with the electric switch device of the present invention.

As shown in FIG. 10, for example eight switch buttons are provided on the cover plate 16 which may be fastened to the shell of the toy by screws. The electric switch device may be switched on by pushing down the switch buttons 2, and it also may be kept switched on by sliding forward the switch buttons 2 so as to insert the inclined surface of the raised portion 3*a* underneath the lower side of the cover plate 16. Therefore, the electric switch device in accordance with the present invention may be applied for a keyed instrument toy which emits a sound for a moment by pushing the switch button, and for a toy performing repeatedly a definite action by keeping an input condition. That is, the electric switch device may be utilized in a computer toy adapting a microcomputer. This means that the electric switch device in accordance with the present invention has a considerably increased field of application.

Furthermore, since the electric switch device is arranged so that the switch button 2 is inserted in the guide hole 17 of the cover plate 16 and the leg 10 extends through the guide hole 14 of the guide plate 15, it is completely controlled in a sliding direction. Since the button 2 and the leg 10 is connected with the supporting frame 9 which is separated from the springy plate 3 by the slots 7 and 8, the supporting frame 9 is slidably held between the cover plate 16 and the guide plate 15, and the button 2 and the leg 10 may be curved down at a fulcrum of the front end portion and may descend together as a one part, while storing a force which moves the device back to its first or inoperative position.

It will be understood that each of the elements described above, or two or more together, may also find a useful application in other types of constructions differing from the types described above.

While the invention has been illustrated and described as embodied in an electric switch device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electric switch device, comprising contact means for closing and opening an electric circuit; actuating means arranged to act on said contact means so that the latter closes and opens the electric circuit, said actuating means including a switch button element movable between a first position in which it does not act on said contact means so that said contact means opens the electric circuit, a second position in which a user applies a pressure to said button element and the latter acts on said contact means so that said contact means closes the electric circuit, but after removal of the user's pressure said button element returns to said first position, and a third position in which said button element acts on said contact means even after removal of the user's pressure so that said contact means keeps the electric circuit closed, said button element including a supporting portion and a movable portion which moves relative to said supporting portion between said positions, said movable portion including a button section arranged to be acted on by a user and a leg section arranged to act on said contact means, said supporting portion of said button element being formed as a reversed gutter, said button element having two slots separating said supporting section from the remainder of said button element and forming in said movable portion a springy section arranged to move said movable portion to said first position; and means for supporting said contact and actuating means, said supporting means having a cover plate provided with an opening having an axis and an edge, said button section projecting through said opening in an axial direction outwardly beyond said cover plate, said movable portion of said button element further having an engaging section which is arranged so that when said button element is moved in the axial direction of said opening, said engaging section is located within said opening and does not engage said cover plate and thereby said button element can assume said first and second positions, but when said button element moves in a radial direction of said opening, said engaging section extends outwardly beyond said edge of said opening and engages said cover plate so that said button element is retained in said third position and cannot be moved to said first position after removal of the user's pressure.

2. An electric switch device as defined in claim 1, wherein said button element includes a supporting portion and a movable portion which moves relative to said supporting portion between said positions, said movable portion including a button section arranged to be acted on by a user and a leg section arranged to act on said contact means.

3. An electric switch device as defined in claim 2, wherein said supporting means has a cover plate provided with an opening having an axis and an edge, said button section projecting through said opening in an axial direction outwardly beyond said cover plate, said movable portion of said button element further having an engaging section which is arranged so that when said button element is moved in the axial direction of said opening, said engaging section is located within said opening and does not engage said cover plate and thereby said button element can assume said first and second positions, but when said button element moves in a radial direction of said opening, said engaging section extends outwardly beyond said edge of said opening and engages said cover plate so that said button element is retained in said third position and cannot be moved to said first position after removal of the user's pressure.

4. An electric switch device as defined in claim 2, wherein said leg section is formed as a triangular plate having a rounded angular corner arranged to act on said contact means.

5. An electric switch device as defined in claim 1, wherein said engaging section of said button element is connected with said springy section and offset relative to the latter in said axial direction.

6. An electric switch device as defined in claim 5, wherein said engaging section has a front edge which faces toward said spring section and is substantially rectangular, said engaging section being inclined and axially raising in direction from said springy section toward said button section of said button element.

7. An electric switch device as defined in claim 5, wherein said supporting portion and said movable portion including said springy section, said engaging section, said button section, and said leg section, are of one piece with one another and together form an integral element.

8. An electric switch device, comprising contact means for closing and opening an electric circuit; actuating means arranged to act on said contact means so that the latter closes and opens the electric circuit, said actuating means including a switch button element movable between a first position in which it does not act on said contact means so that said contact means opens the electric circuit, a second position in which a user applies a pressure to said button element and the latter acts on said contact means so that said contact means closes the electric circuit, but after removal of the user's pressure said button element returns to said first position, and a third position in which said button element acts on said contact means even after removal of the user's pressure so that said contact means keeps the electric circuit closed, said button element including a supporting portion and a movable portion which moves relative to said supporting portion between said positions, said movable portion including a button section arranged to be acted on by a user and a leg section arranged to act on said contact means; and means for supporting said contact and actuating means, said supporting means having a cover plate provided with an opening having an axis and an edge, said button section projecting through said opening in an axial direction outwardly beyond said cover plate, said movable portion of said button element further having an engaging section which is arranged so that when said button element is moved in the axial direction of said opening, said engaging section is located within said opening and does not engage said cover plate and thereby said button element can assume said first and second positions, but when said button element moves in a radial direction of said opening, said engaging section extends outwardly beyond said edge of said opening and engages said cover plate so that said button element is retained in said third position and cannot be moved to said first position after removal of the user's pressure, said supporting means further having a guiding plate spaced from said cover plate in the axial direction and provided with an opening through which said leg section of said bottom element extends, said plates being arranged relative to one another so that when said button element moves in the radial direction, said supporting portion and said springy and engaging sections of said movable portion of said button element are guided between said plates.

9. An electric switch device as defined in claim 8, wherein said supporting means further comprises a base plate axially spaced from said guiding plate and located at an opposite side of the latter relative to said cover plate, said base plate supporting said contact means.

10. An electric switch device as defined in claim 9, wherein said contact means includes a stationary contact member mounted stationarily on said base plate, and a movable contact member mounted on said base plate movably relative to the latter and to said stationary contact member, said leg section of said button element being arranged to act on said movable contact member so that in said second and third positions said movable contact member contacts with said stationary contact member whereby said contact means closes the electric circuit, and in said first position said stationary contact member does not contact with said stationary contact member whereby said contact means opens the electric circuit.

11. An electric switch device as defined in claim 10, wherein said movable contact member is formed as a springy plate having one end fixedly connected with said base plate and another free end which is movable relative to said stationary contact member under the action of said leg section of said button element, so as to contact or not contact with said stationary contact member.

12. An electric switch device as defined in claim 10, wherein said cover plate, guiding plate and base plate are parallel to each other.

13. An electric switch device, comprising contact means for closing and opening an electric circuit; actuating means arranged to act on said contact means so that the latter closes and opens the electric circuit, said actuating means including a switch button element movable between a first position in which it does not act on said contact means so that said contact means opens the electric circuit, a second position in which a user applies a pressure to said button element and the latter acts on said contact means so that said contact means closes the electric circuit, but after removal of the user's pressure said button element returns to said first position, and a third position in which said button element acts on said contact means even after removal of the user's pressure so that said contact means keeps the electric circuit closed, said button element including a supporting portion and a movable portion which moves relative to said supporting portion between said positions, said movable portion including a button section arranged to be acted on by a user and a leg section arranged to act on said contact means, said supporting portion of said button element being formed as a reversed gutter, said button element having two slots separating said supporting section from the remainder of said button element and forming in said movable portion a springy section arranged to move said movable portion to said first position; and means for supporting said contact and actuating means.

14. An electric switch device as defined in claim 3, wherein said movable portion of said button element further has a tail section which is located at a radially opposite side of said button section relative to said supporting portion, said tail section abutting against said cover plate when said button element is in said first position.

15. An electric switch device for a toy, comprising contact means for closing and opening an electric circuit; actuating means arranged to act on said contact means so that the latter closes and opens the electric circuit, said actuating means including a switch button element movable between a first position in which it does not act on said contact means so that said contact means opens the electric circuit, a second position in which a user applies a pressure to said button element and the latter acts on said contact means so that said contact means closes the electric circuit, but after removal of the user's pressure said button element returns to said first position, and a third position in which said button element acts on said contact means even after removal of the user's pressure so that said contact means keeps the electric circuit closed; means for supporting said contact and actuating means; and means for performing a predetermined action upon closing said electric circuit so that when said electric circuit is closed by said switch button element in said second position said performing means performs said action for an instant, whereas when said electric circuit is closed by said switch button element in said third position, said performing means perform said action continuously, said performing means being formed as sound emitting means arranged to emit sound for an instant and continuously, respectively.

* * * * *